US006688688B2

(12) United States Patent
Uhlenbrock

(10) Patent No.: US 6,688,688 B2
(45) Date of Patent: Feb. 10, 2004

(54) CHAIR

(75) Inventor: Johannes Uhlenbrock, Drensteinfurt (DE)

(73) Assignee: Peter Roeder, Frankfurt (DE)

( * ) Notice: Subject to any disclaimer, the term of this patent is extended or adjusted under 35 U.S.C. 154(b) by 26 days.

(21) Appl. No.: 10/050,748

(22) Filed: Jan. 16, 2002

(65) Prior Publication Data

US 2002/0084681 A1 Jul. 4, 2002

Related U.S. Application Data

(63) Continuation of application No. PCT/EP01/05692, filed on May 18, 2001.

(51) Int. Cl.[7] ..... A47C 1/24

(52) U.S. Cl. ..... 297/300.4; 297/300.1; 297/316

(58) Field of Search ..... 297/300.1, 300.2, 297/300.4, 316, 320, 321

(56) References Cited

U.S. PATENT DOCUMENTS

| | | | | | |
|---|---|---|---|---|---|
| 3,369,840 | A | * | 2/1968 | Dufton | 297/300.1 |
| 4,575,150 | A | * | 3/1986 | Smith | 297/300.4 |
| 4,709,962 | A | * | 12/1987 | Steinmann | 297/300.3 |
| 4,865,384 | A | * | 9/1989 | Desanta | 297/300.4 |
| 5,114,211 | A | * | 5/1992 | Desanta | 297/300.4 |
| 5,383,712 | A | * | 1/1995 | Perry | 297/448.2 |
| 5,397,165 | A | * | 3/1995 | Grin et al. | 297/300.5 |
| 6,000,755 | A | * | 12/1999 | Uhlenbrock | 297/300.2 |
| 6,109,694 | A | * | 8/2000 | Kurtz | 297/320 |
| 6,234,573 | B1 | * | 5/2001 | Roder et al. | 297/300.5 |
| 6,523,896 | B1 | * | 2/2003 | Uhlenbrock | 297/300.4 |

FOREIGN PATENT DOCUMENTS

| | | | |
|---|---|---|---|
| DE | WO-9816139 A | * | 4/1998 |
| DE | 1066775 A1 | * | 6/2000 |

* cited by examiner

*Primary Examiner*—Peter M. Cuomo
*Assistant Examiner*—Joseph Edell
(74) *Attorney, Agent, or Firm*—Sonnenschein Nath & Rosenthal

(57) ABSTRACT

This invention concerns a chair with a seat panel, with a central column or several legs and with a backrest carrier. In order to provide a tilting movement, the front of the seat panel rests on a horizontal, crosswise running first pivot and, in order to provide a tilting movement, the rear of the seat panel is attached to the backrest carrier around a second pivot. The backrest carrier is attached to the central column or the legs around a third pivot. The springs are arranged so that they exert an upward force on the seat panel and a forward force on the backrest. An arrangement of springs is provided that has at least one gripped spring, comprising bent spring-steel rod or wire, attached to the central column or the chair legs with at least one first and one second leg of the spring. The spring is hinged to the seat panel and supports the seat panel with one or more spring sections, and, at the same time, forms the first pivot. Further, the spring rests on the seat panel and on the backrest carrier and is pre-stressed in such a way that it exerts an upward force on the seat panel and a forward force on the backrest via the backrest carrier.

28 Claims, 6 Drawing Sheets

CHAIR

This application is a continuation of International Application PCT/EP01/05692, filed May 18, 2001. The present and foregoing application claims priority to German Patent Application No. 100 26 531.6, filed May 27, 2000. All of the foregoing applications are incorporated herein by reference to the extent permitted by law.

BACKGROUND OF THE INVENTION

This invention concerns a chair with a seat panel that is carried by a central column or several legs, and with a backrest carrier that runs backwards under the seat panel and upwards behind the seat panel and carries a backrest. Near its front edge, in order to provide a tilting movement, the seat panel rests on a horizontal, crosswise running first pivot and, near its back edge, to provide a tilting movement, it is attached to the backrest carrier around a second, parallel pivot. The backrest carrier is attached to the central column or the legs around a third pivot that runs between the first and second pivots and is parallel to them. The springs are arranged so that they exert an upward force on the seat panel and a forward force on the backrest.

A chair of this kind is known from DE 43 13 301 C2. This chair is characterized by the fact that, on the underside of the seat panel, at the front and at the back, downward directed supports are rigidly fastened in pairs. The bottom ends of the front supports are fastened to the bottom ends of downward connecting rods that are fastened to the seat panel carrier to allow for a tilting movement. The bottom ends of the rear supports are connected to the backrest carrier to allow for a tilting movement. The springs are arranged in the form of a coil spring between the seat panel and the seat panel carrier.

With this construction of the chair, there is a so-called synchronous mechanism whereby, if the user leans back on the chair, thereby putting a load on the rear part of the seat panel, the seat panel sinks down and, at the same time, the backrest tilts backwards and this tilting movement works against the force of the springs. As this happens, the angle of tilt of the backrest is normally larger than the angle of tilt of the seat panel. The relationship of the angles of tilt towards each other is determined by the jointly acting lengths of the levers.

The disadvantage of this chair is that the preload force of the backrest depends solely on the strength of the arrangement of the compression springs and on the leverage determined by the construction of the chair. That is why, in this case, it is impossible to adapt the preload force of the backrest to the different body weights of different users of the chair. It would only be possible to influence the preload force of the backrest through an arrangement of springs that can be adjusted or pre-set. However, to do this, the user of the chair would have to carry out the adjustment manually, which would be an undesirably high expenditure of effort, especially if the chair is used by different users of different weights. What is more, it is not guaranteed that the user will actually make the correct adjustment. This could give rise to incorrect adjustments of the preload force of the backrest which, in some cases, could be damaging to the user's health.

SUMMARY OF THE INVENTION

The present invention therefore sets out to create a chair of the kind described above, which avoids the disadvantages that have been illustrated and in which the automatic adjustment of the preload force of the backrest to users of varying weights is possible and in which the constructional outlay, especially the number of individual components that are required, is kept low.

The distinctive features of the chair according to the invention also have the synchronous mechanism whereby, when sat upon, the seat panel moves downwards against the force of the spring arrangement according to the weight of the user. This necessarily leads to a corresponding increase in the stress of the spring arrangement. As the spring arrangement rests on the backrest carrier, the increased stress of the spring arrangement exerts an increased lever moment on the backrest carrier, which gives rise to an increase in the preload force of the backrest. A person using the chair with a heavier bodyweight therefore experiences greater support for his or her back from the backrest, which is desirable and makes ergonomic sense. If a user with a lighter bodyweight sits on the chair, the seat panel takes up a higher position in which the spring arrangement has less stress placed upon it; this necessarily gives rise to a correspondingly lower preload force being exerted on the backrest, so that a user with a lighter bodyweight experiences a commensurately lower support force exerted by the backrest on his or her back, in line with his or her lighter bodyweight. At the same time, the synchronous adjustment of the seat panel and the backrest is completely preserved, so that, if the position of the seat panel is changed, the seat panel and the backrest tilt in a fixed relationship to each other.

Despite the synchronous mechanism and the automatic adjustment of the preload force exerted on the backrest to the different bodyweights of the users, the chair is of a surprisingly simple construction, so that, in relation to the functions that are offered, the manufacture of the chair is simple and cost-effective. In particular, a separate seat panel carrier is no longer required since the spring arrangement carries the seat panel close to its front edge and positions the seat panel so that it can tilt. The spring arrangement can easily be bent into the necessary shape. It is possible to modify the force of the springs without any problem by changing the strength of the material of the spring-steel rod or wire or by changing the lengths of the legs of the spring.

In order to achieve an especially flat design of the mechanism which requires less height under the seat panel, it is preferable that the backrest carrier has an extension going forward beyond the third pivot to form a lever arm and that the spring rests on this backrest carrier extension on which it exerts a downward force. This design of the mechanism that is necessary for the movement of the chair also gives the chair an attractive appearance and is especially suitable if the chairs are to be stacked.

The chair has also been designed so that the spring arrangement is formed by two springs which, seen from above, are bent into the shape of a U, and are arranged next to each other under the seat panel as a mirror image. The first U-shaped leg of the spring is clamped to the chair column or chair legs and points backwards, the U-shaped bend of the spring forms the section of the spring attached to the seat panel for the first pivot and the second U-shaped leg of the spring rests on the extension of the backrest carrier. These U-shaped springs are particularly flat in construction and are easy to manufacture as bending components. The use of two springs ensures that the forces are well distributed and avoids undesired lateral tipping movements of the seat panel.

A development of the design that has been illustrated above consists in combining the two U-shaped bent springs that form the spring arrangement into a one-piece spring that is shaped, seen from above, into a W, and is arranged underneath the seat panel symmetrically to the longitudinal central axis of the seat panel. This reduces production and assembly costs when the chair is being manufactured.

It is also proposed that a clamping device, preferably a gripping sleeve, is firmly attached to the chair column or chair legs for each of the first legs of the spring. In this way, arranging the springs is easy and, at the same time, the resulting arrangement is visually very unobtrusive.

An alternative design of the chair allows for the backrest carrier to terminate at the third pivot, and for the springs behind the third pivot to rest on the backrest carrier and to exert an upward force on the backrest carrier. This design also enables the functions illustrated above to be carried out. In this case, a different spring arrangement can be used in view of its working direction. This increases technical freedom during the manufacture of the chair and, in particular, in the choice of the springs that are to be used.

A development of the design of the chair described above is characterized by the fact that the spring arrangement is formed by means of two tangentially loaded helical springs, each with a coiled spring body and two legs.

In this case, the springs are arranged next to each other under the seat panel in a mirror image—the spring body surrounds the third pivot, the first leg of the spring, pointing forwards, rests against the seat panel and its front end forms the spring section for the first pivot, which is attached to the seat panel, and the second leg of the spring, pointing backwards, rests on the backrest carrier. It is true that tangentially loaded helical springs need more height but their spring features are easier to influence and determine. What is more, they generally allow for greater spring movement and hence greater chair comfort.

In a further, more advantageous, arrangement, the two tangentially loaded helical springs forming the spring arrangement are combined into a one-piece double tangentially loaded helical spring, which is arranged under the seat panel symmetrically to the longitudinal central axis of the seat panel. This simplifies the manufacture and assembly of the chair mechanism.

As regards the design of the chair using tangentially loaded helical springs, it is preferable that a stop, preferably a stop plate, is attached to the chair column or the chair legs for each of the first legs of the spring, in order to restrict its upward movement. In this way, a defined upper end position for the seat panel is established when the chair is not in use. This stops the seat panel from rising excessively high when there is no load on it.

Instead of the spring arrangement described above, other, alternative, spring arrangements can be used, provided the necessary forces are exerted in the required directions as illustrated above.

Preferably, in all the chair designs at least two front brackets and at least two rear brackets are attached to the underside of the seat panel, through which the first and second pivots run respectively. In this way, the forces that are exerted when the chair is in use are conveniently directed towards, and lead away from, the seat panel. What is more, it is easy to attach a modified seat panel which, together with an equally easily replaced attached backrest, allows the chair to be adjusted in a myriad of ways.

The invention also allows a bearing pin in the shape of a rod or tube to be placed beneath the seat panel to form the third pivot. This is firmly attached to the chair column or chair legs and the backrest carrier rests on it in such a way that it can tilt. Apart from forming the third pivot, this pin also serves as a cross brace, which increases the stability of the chair, especially when it is designed with four legs.

As explained above, the chair preferably has a combination of the synchronous mechanism and weight-dependent backrest preload. For users who do not want the synchronous mechanism, the chair can alternatively be designed so that the synchronization of the seat panel with the backrest carrier and the second rear pivot are omitted, so that the seat panel and the backrest carrier can tilt in an unsynchronized manner, i.e., independently of each other. The necessary technical modifications are restricted to omitting the individual components, in particular the rear carrier pin and the accompanying brackets.

BRIEF DESCRIPTION OF THE DRAWING

Three design examples of the invention are illustrated with the help of a drawing. The figures in the drawing show.

DETAILED DESCRIPTION OF THE PREFERRED EMBODIMENT

Figure 1:
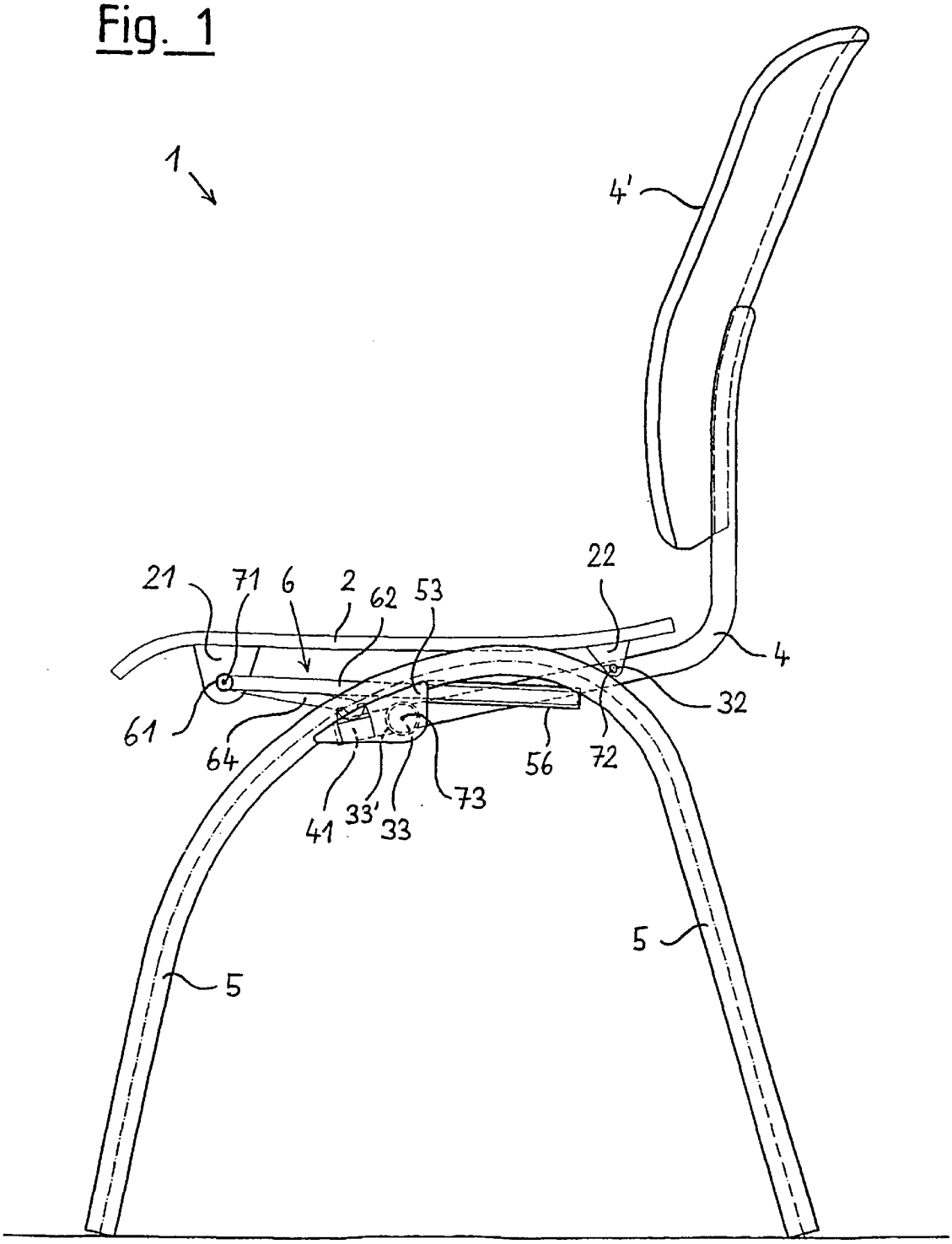
FIG. 1 illustrates a chair designed as a conference chair (first design), viewed from the side.

The essential components of the chair 1, which is illustrated in FIG. 1 as an example of the first design, are a seat panel 2, a backrest carrier 4 with a backrest 4', a chair ground support in the form of four chair legs 5 and a spring arrangement 6. The chair legs 5 are designed in one piece as a more-or-less U shaped bend and are fitted to the left and right of the chair, with the U-legs forming the chair legs. The spring arrangement consists of a spring 6, which is formed from a bent spring-steel rod. The spring 6 is more or less W-shaped when viewed from underneath, as described in more detail in FIG. 2. The ends of two lateral outer legs 62 of the spring 6 are clamped by gripping sleeves 56, which are firmly attached to the chair legs 5.

The seat panel 2 is a stable panel, which can have a cushion placed on top of it (not illustrated). Four front brackets 21 and two rear brackets 22 are attached to the underneath of the seat panel 2. The brackets 21 and 22 are arranged behind each other, as illustrated in the side view given in FIG. 1, so that only one of the brackets 21 and 22 is visible.

In the drawing, the front brackets 21 are arranged close to the left front side of the seat panel 2 and each of them has a hole. A front section 61 of the spring 6 runs through the front brackets 21 thereby forming a first pivot 71 for the seat panel 2.

Each of the rear, second brackets 22 also has a hole, through which a bearing pin 32 runs horizontally across the chair. In addition, this second bearing pin 32 also runs through the backrest carrier 4, and forms with it a lag hinge with a second pivot 72, which runs parallel to the first pivot 71.

The backrest carrier 4, which carries the backrest 4', is formed in one piece by means of a section, e.g., a tube that is bent more or less in the shape of a right angle. The backrest carrier 4 first runs backwards underneath the seat panel 2 and then bends upwards. The backrest 4' is attached to the upper end of the backrest carrier 4.

The first section of the backrest carrier 4, which runs under the seat panel 2, rests upon a third pivot 73, which runs parallel to the other pivots 71 and 72, by means of a bearing sleeve 33' and a bearing pin 33, which is firmly attached to the chair legs 5, thereby allowing for a tilting movement. Furthermore, the backrest carrier 4 has an extension 41 which points forward over the bearing pin 33. With its second leg 64, which points backwards from the spring section 61, the upper side of the spring 6 is supported on the forward pointing extension 41 of the first section of the backrest carrier. The spring 6 is preset so that, on the one hand, it exerts an upward preload force on the seat panel 2 and, on the other hand, a forward preload force on the backrest 4' via the backrest carrier 4.

At the same time, it is possible for the seat panel 2 of the chair 1 to move in a vertical direction in relation to the chair legs 5. This vertical movement can be more or less directly vertical or it can be in the form of tilting movements around the first, front pivot 71 or around the second rear pivot 72.

In FIG. 1, the chair 1 is illustrated in an unloaded state, in which no force is exerted on the seat panel 2 or on the backrest 4' by a user of the chair 1. The forward tilting movement of the backrest carrier 4 in this position is restricted by an invisible stop.

When the weight of a user is put upon the chair 1, the seat panel 2 moves downwards to a greater or lesser extent, depending on the bodyweight of the user. When the seat panel 2 is sat upon by a heavy user, the section 61 of the spring 6 is bent downwards with greater force and hence receives greater stress. As a result, the leg 64 of the spring 6 exerts a correspondingly greater downward force on the extension 41 of the backrest carrier 4 which, through the leverage effect, necessarily results in the backrest 4' receiving a greater forward preload force and so the user's back is supported with greater force. If a lighter person uses the chair 1, the seat panel 2 is pressed downwards to a correspondingly lesser degree, in which case the spring 6 receives less stress and then the backrest 4' experiences a lower preload force. Therefore the preload force, or support force, of the backrest 4' automatically adjusts to users of different weights.

The chair 1 also offers a synchronous mechanism so that the position of the seat panel 2 and the backrest 4', coupled together, can change.

When a user leans backwards on the chair 1, the seat panel 2 sinks down against the force of the spring 6. At the same time, the backrest 4' sinks backwards in a fixed tilting angle relationship through the resulting leverage.

As an alternative to the illustrated design, the backrest 4' can rest on a horizontal crosswise running pivot to allow it to tilt in relation to the backrest carrier 4, as is already known. This enables the backrest 4' to better adjust to different users of the chair 1.

Figure 2:
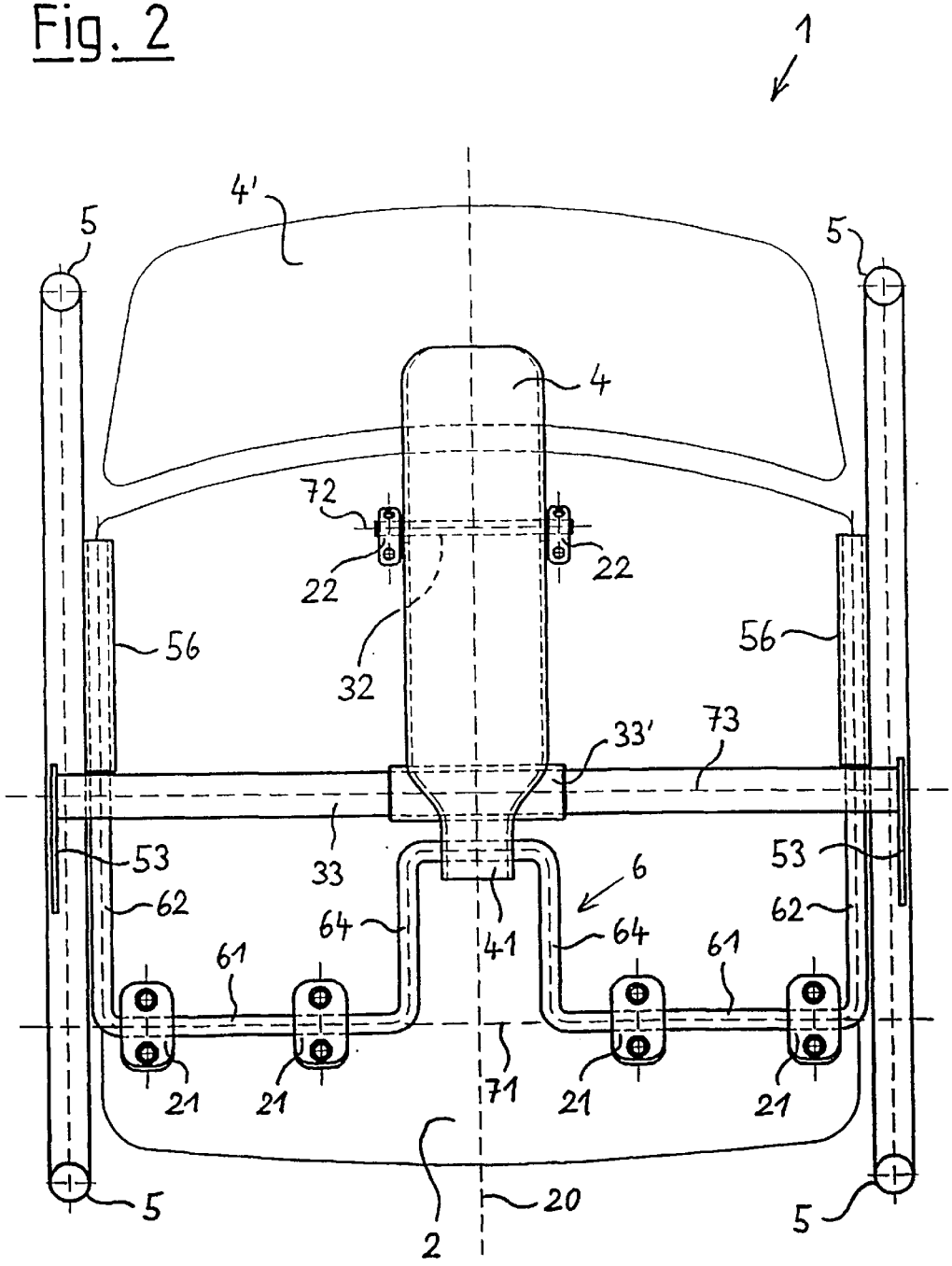
FIG. 2 illustrates the chair of FIG. 1 viewed from underneath.

The view from below of the chair 1 from FIG. 1, which is illustrated in FIG. 2 of the drawing, clearly shows the symmetrical arrangement of the mechanism of the chair 1 on both sides of the longitudinal central axis 20 of the seat panel 2, which is visible in the background. In the center, parallel to the axis 20, is the backrest carrier 4, which carries the backrest 4' on its rear, upper end as shown in FIG. 2. At right angles to the backrest carrier 4 stretch two bearing pins 32 and 33, which run parallel to each other under the seat panel 2 across the chair 1 and form the second and third pivots 72 and 73. The ends of the rear, shorter bearing pin 32 lie in the rear brackets 22, which are attached to the seat panel 2 on either side of the backrest carrier 4. The ends of the central bearing pin 33, which extends right across the entire width of the seat panel 2, are attached to two lateral carrier panels 53, which are firmly attached to the chair legs 5.

The backrest carrier 4 is placed on the central bearing pin 33 by means of a bearing sleeve 33' around the pivot 73 to allow for a pivoting movement. In front of this bearing pin, i.e., under it in FIG. 2, is the extension 41 of the backrest carrier 4.

The spring 6, with its central legs 64, rests on this extension 41. With its two lateral outer legs 62 the spring 6 is gripped by the lateral clamping sleeves 56, which are firmly fixed to the chair legs 5. The sections 61 of the spring 6, that are close to the front edge of the seat panel 2 and are illustrated at the bottom of the drawing, run at right angles to the central axis 20 through the four front brackets 21 and form the first pivot 71.

FIG. 2 clearly shows the very simple and clear construction of the mechanism of the chair 1, which makes the chair very easy to produce and keeps the size compact. The construction is both stable and resistant to wear and tear. What is more, when not in use, the chair 1 can be stacked away to save room, which was previously only possible with simple chairs, which did not have a synchronous mechanism or did not adjust the backrest force automatically to the weight of the user.

Figure 3:
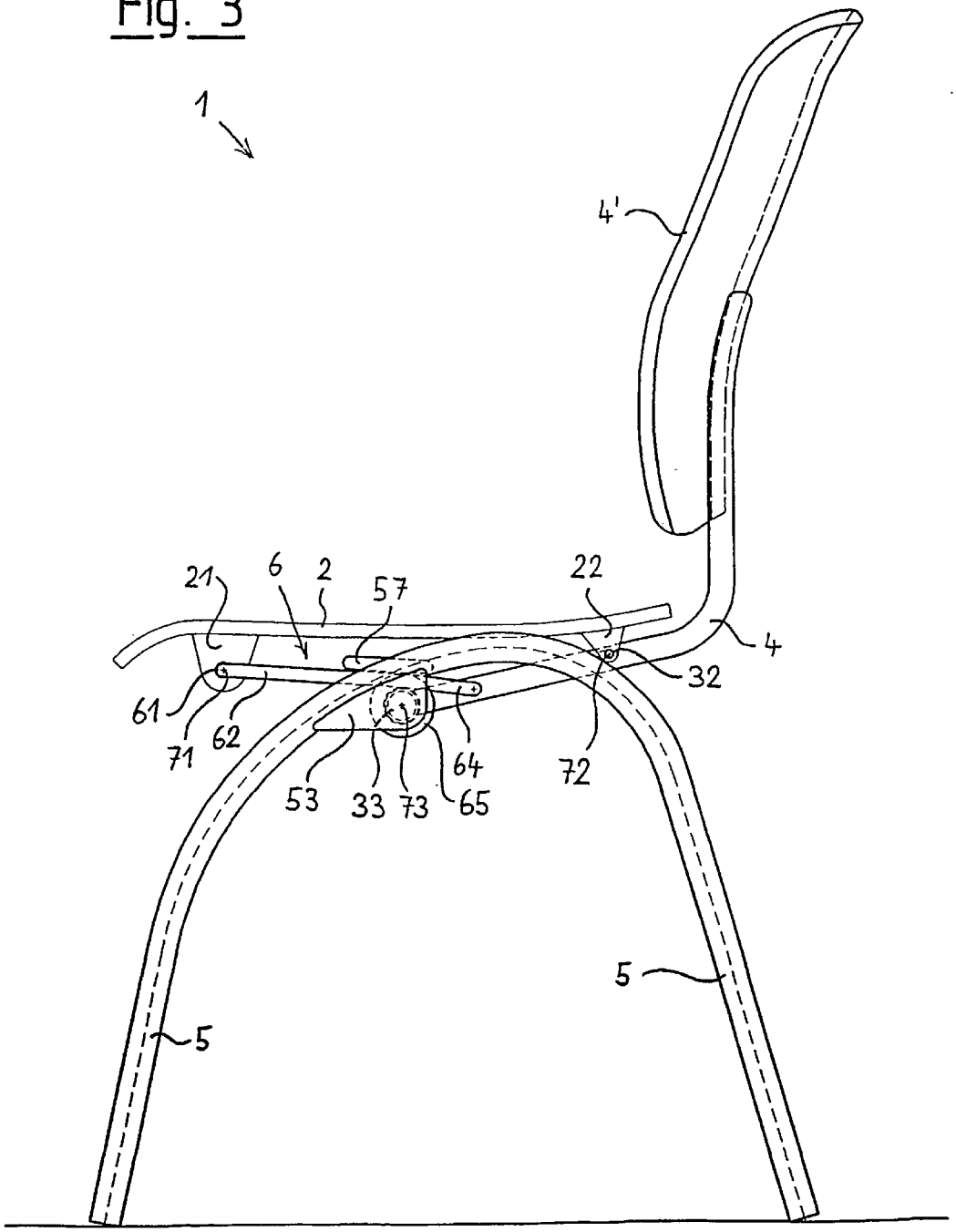
FIG. 3 illustrates the chair designed as a conference chair (second design), also viewed from the side.
Figure 4:
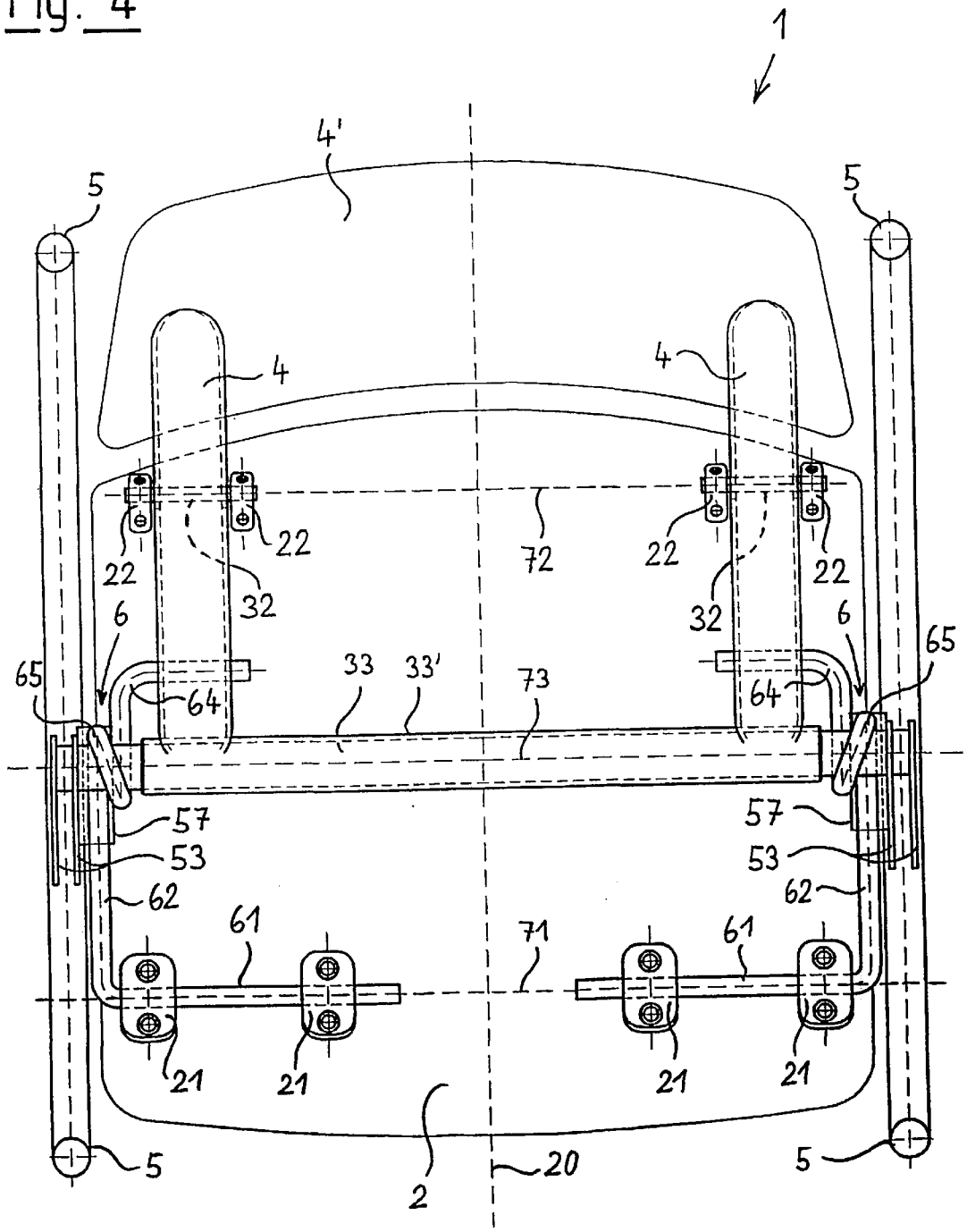
FIG. 4 illustrates the chair of FIG. 3, viewed from underneath.

FIGS. 3 and 4 of the drawing show, as a second design example, a conference chair 1, which, unlike the chair in FIGS. 1 and 2, is equipped with two springs 6 and two backrest carriers 4.

This chair 1 design also includes a stable seat panel 2, on the underside of which four front and four rear brackets 21 and 22 are attached. The chair legs 5 are rigidly attached to each other via the central bearing pin 33, which forms a cross traverse and, at the same time, forms the third pivot 73. This design also has two rear bearing pins 32, the ends of which are firmly held inside the accompanying rear brackets 22, thereby forming the second pivot 72.

The backrest carriers 4 terminate at the central bearing pin 33 and are attached, e.g., welded, to a pivoted bearing sleeve 33', which rests upon this bearing pin 33. The backrest carriers 4 therefore do not have an extension jutting out over the third pivot 73. The top ends of the backrest carriers 4 again carry the backrest 4'. The backrest 4' and the backrest carriers 4, therefore, rest in a tilting manner on the bearing pin 33 or the third pivot 73. The coiled body 65 of the springs 6, which here are tangentially loaded helical springs or leg springs, are clamped onto the central carrier pin 33 on the left and right on the outside near the gripping sleeve 33'. The first two legs of the spring 62 run from the body of the spring 65 towards the front, where they are bent across the seat panel 2 and are led through the front brackets 21. In this way, these sections 61 of the spring 6 form the first pivot 71. The second two legs of the spring 64 run from the body of the spring towards the back, where their ends rest on the backrest carrier 4 behind the third pivot 73. The tangentially loaded helical spring 6 is pre-stressed in such a way that the first leg 62 exerts an upward force on the seat panel 2 and the second leg 64 also exerts an upward force on the backrest carrier 4. The upward movement of the seat panel 2 is limited by two lateral stops 57, which are firmly attached to the chair legs 5 and against which the first legs of the spring 62 press.

With regard to the movements of the seat panel 2 and the backrest carrier 4 together with the backrest 4', the chair 1 in FIGS. 3 and 4 behaves in the same way as the chair 1 in FIGS. 1 and 2. Here too, there is automatic adjustment of the preload force of the backrest 4' to the bodyweight of the user of the chair 1. In addition, also in the case of the chair 1 according to FIGS. 3 and 4, the synchronous mechanism controlling the coupled tilting of the seat panel 2 and the backrest carrier 4 together with the backrest 4' is guaranteed.

Also in the case of the chair 1 according to FIGS. 3 and 4, the entire mechanism under the seat panel 2 is very compact, so this chair 1 can also be stacked for the purposes of storage and transportation, resulting in an arrangement that saves a lot of space.

Figure 5:
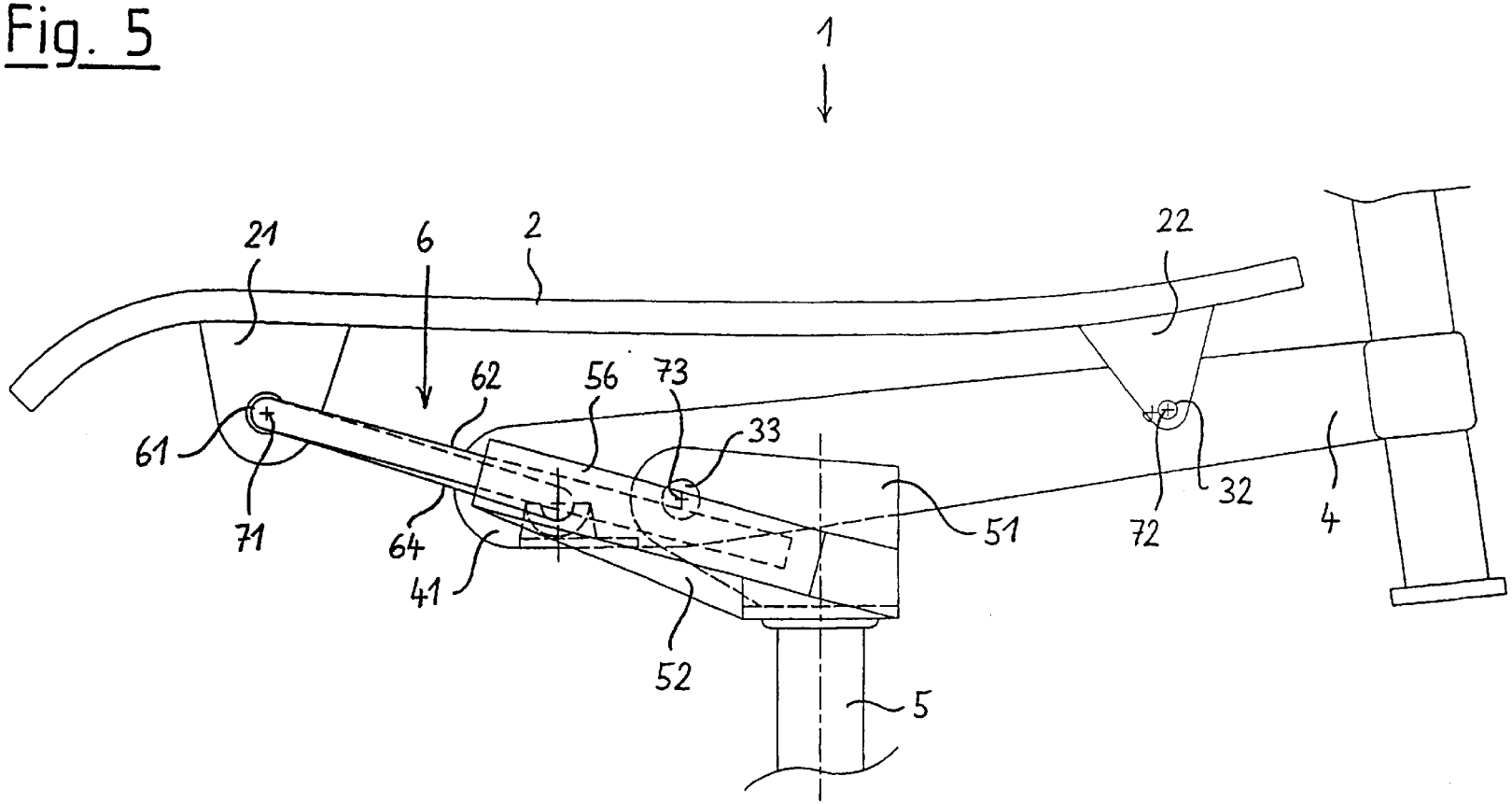
FIG. 5 illustrates the chair designed as an office swivel chair (third design)-partial side view.
Figure 6:
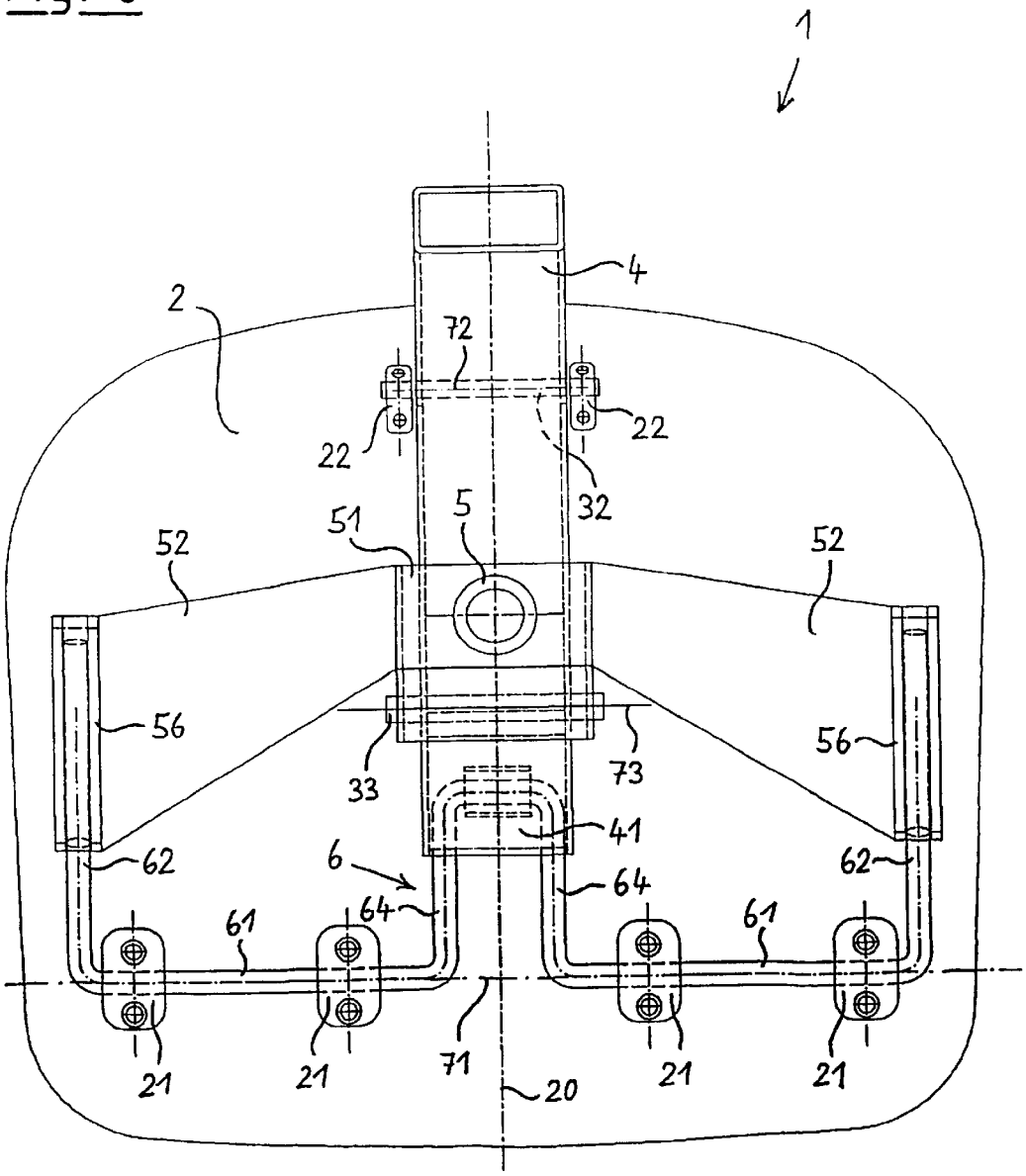
FIG. 6 illustrates the chair of FIG. 5, viewed from underneath.

FIGS. 5 and 6 of the drawing show a design example of the chair 1, in which the chair 1 is designed as an office swivel chair, hence with a chair ground support in the form of a central chair column 5. The top of the central chair column 5 terminates in a head 51, through which the central, third bearing pin 33 runs. The backrest carrier 4 can tilt around this bearing pin 33, which forms the third pivot 73. The top of the backrest carrier 4 again carries the backrest (not illustrated).

The chair 1 according to FIGS. 5 and 6 has a seat panel 2, on the underside of which are four front brackets 21 and two rear brackets 22. The chair 1 has a spring 6, which has been designed in a similar way to that in the example shown in FIGS. 1 and 2. As is made especially clear in FIG. 6, the spring 6 is bent into a W shape and is arranged under the seat panel 2 as a mirror image on either side the longitudinal central axis 20 of the seat panel 2. In this example, too, the spring 6 has two front spring sections 61, which run across the seat panel 2 and through the front brackets 21 and form the first pivot 71. Along the sides, on the outside, two legs of the spring 62 run from the spring sections 61 towards the back. The rear sections of the legs of the spring 62 are held fast by two lateral, outer gripping sleeves 56. The outer ends of the gripping sleeves 56 are firmly attached to two wings 52, which themselves are firmly attached to the head 51 of the central chair column 5.

Two inner legs of the spring 64 run from the spring sections 61 towards the back and the ends of the legs of the spring 64 are joined together to form a single piece. In this area, the legs of the spring 64 rest on the top of the extension 41 of the backrest carrier 4. The spring 6 is pre-stressed in such a way that it exerts an upward force on the seat panel 2 and a downward force on the extension 41 of the backrest carrier 4. The downward force, which is exerted on the extension 41 of the backrest carrier 4, exerts a preload force on the backrest in the direction of the user of the chair.

As regards its function, the chair illustrated in FIGS. 5 and 6 corresponds to the previously described design examples shown in FIGS. 1 to 4. Here too, therefore, the preload force of the backrest automatically adjusts depending on the weight of the user of the chair 1. By the same token, there is also a synchronous mechanism controlling the movement of the seat panel 2 and the backrest carrier 4. As FIG. 5 makes especially clear, in the case of the design of the chair 1 as an office swivel chair, the mechanism under the seat panel 2 is also very compact and requires very little height and few individual components.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

The embodiments of the invention in which an exclusive property or privilege is claimed are defined as follows:

1. A chair with a seat panel, which is carried by a chair ground support, and with a backrest carrier, which runs backward under the seat panel and upward behind the seat panel and carries a backrest, wherein near a front edge of the seat panel, in order to provide a tilting movement, the seat panel rests on a horizontal, crosswise running first pivot and, near a back edge of the seat panel, to provide a tilting movement of the seat panel, is attached to the backrest carrier around a second, parallel pivot, wherein the backrest carrier is attached to the chair ground support around a third pivot that runs parallel between the first and second pivots, and wherein a spring arrangement is provided so that the spring arrangement exerts an upward force on the seat panel and forward force on the backrest via the backrest carrier, wherein the spring arrangement includes at least one gripped spring, comprising bent spring-steel rod or wire, attached to the chair ground support with at least one first free end and one second free end leg of the spring, the spring is hinged to the seat panel and supports the seat panel with one or more spring sections, and, at the same time, forms the first pivot and the spring rests on the seat panel and on the backrest carrier and is pre-stressed in such a way that the spring exerts an upward force on the seat panel and a forward force on the backrest via the backrest carrier, the seat panel being supported solely by said spring near the front edge and by the backrest carrier near the back edge.

2. A chair according to claim 1, wherein the backrest carrier has an extension going forward beyond the third pivot to form a lever arm, and the spring rests on the backrest carrier extension on which the spring exerts a downward force.

3. A chair according to claim 2, wherein the spring arrangement is formed by two springs, which, seen from above, are bent into the shape of a U, and are arranged next to each other under the seat panel as a mirror image, wherein a first U-shaped leg of the spring is clamped to the chair ground support pointing backward, the U-shaped bend of the spring forms the spring section attached to the seat panel for the first pivot, and the second U-shaped leg of the spring is supported on the extension of the backrest carrier.

4. A chair according to claim 1, wherein the spring arrangement comprises a one-piece spring, that is shaped, when seen from above, into a W, with the two legs both extending to the free ends in a first direction on opposite outer sides of the spring, a central bight extending in the first direction, and two intermediate bights, one between each leg and the central bight, the intermediate bights each extending in a second direction, opposite the first direction, and is arranged underneath the seat panel symmetrically to the longitudinal central axis of the seat panel.

5. A chair according to claim 1, wherein a clamping device, preferably a gripping sleeve, is firmly attached to the chair ground support for each of the first legs of the spring.

6. A chair according to claim 1, wherein the backrest carrier terminates at the third pivot and the spring rests behind the third pivot on the backrest carrier, on which the spring exerts an upward force.

7. A chair according to claim 6, wherein the spring arrangement is formed by means of two tangentially loaded helical springs or leg springs, each with a coiled spring body and two legs, wherein the springs are arranged next to each other under the seat panel in a mirror image, the spring body surrounds the third pivot, the first leg of the spring, pointing forward, rests against the seat panel and, on said front leg front end, forms the spring section which is attached to the seat panel for the first pivot, and the second leg of the spring, pointing backward, rests on the backrest carrier.

8. A chair according to claim 7, wherein the two tangentially loaded helical springs or leg springs, forming the spring arrangement, are combined into a one-piece double tangentially loaded helical spring or leg spring, which is arranged under the seat panel symmetrically to the longitudinal central axis of the seat panel.

9. A chair according to claim 7, wherein a stop, preferably a stop plate, is attached to the chair ground support for restricting the upward movement of each of the first legs of the spring.

10. A chair according to claim 1, wherein at least two front brackets and at least two rear brackets are attached to the underside of the seat panel, through which the first pivot and the second pivot run respectively.

11. A chair according to claim 1, wherein a bearing pin in the shape of a rod or tube is arranged beneath the seat panel to form the third pivot, wherein the bearing pin is firmly attached to the chair ground support and on which the backrest carrier can tilt.

12. A chair according to claim 1, wherein the synchronization of the seat panel with the backrest carrier and the second seat pivot are omitted and the seat panel and the backrest carrier can tilt in an unsynchronized manner, that is, independently of each other.

13. A chair comprising:

a seat panel, a backrest, a chair ground support for carrying said seat panel, a backrest carrier, which runs backward under said seat panel and upward behind said seat panel and carries said backrest, wherein near a front edge of said seat panel, in order to provide a tilting movement, said seat panel rests on a horizontal, crosswise running first pivot and, near a back edge of said seat panel, to provide a tilting movement, said seat panel is attached to said backrest carrier around a second, parallel pivot, said backrest carrier being attached to said chair ground support around a third pivot that runs parallel between said first and second pivots, at least one spring arranged so that said spring exerts an upward force on said seat panel and a forward force on said backrest, wherein said spring comprises at least one gripped spring, attached to said chair ground support with at least one first and one second leg of said spring, said spring being hinged to said seat panel and supporting said seat panel with at least one spring section, and forming said first pivot, and said spring resting on said seat panel and on said backrest carrier and being pre-stressed in such a way that the spring exerts an upward force on said seat panel and a forward force on said backrest via said backrest carrier, the seat panel being supported solely by said spring near said front edge and by said backrest carrier near said back edge.

14. A chair according to claim 13, wherein said spring comprises a bent spring-steel rod or wire.

15. A chair according to claim 13, wherein said chair ground support comprises a plurality of legs.

16. A chair according to claim 13, wherein said chair ground support comprises a post.

17. A chair according to claim 13, wherein said backrest carrier has an extension going forward beyond said third pivot to form a lever arm, and said spring rests on said backrest carrier extension on which the spring exerts a downward force.

18. A chair according to claim 13, wherein said spring is formed by two springs, which, seen from above, are each bent into the shape of a U, and are arranged next to each other under said seat panel as a mirror image, wherein a first U-shaped leg of each spring is clamped to the chair ground support pointing backward, a U-shaped bend of each spring forms said spring section attached to said seat panel for said first pivot, and a second U-shaped leg of said spring is supported on said extension of said backrest carrier.

19. A chair according to claim 13, wherein said spring arrangement comprises a one-piece spring, that is shaped, when seen from above, into a W, with the two legs both extending to the free ends in a first direction on opposite outer sides of the spring, a central bight extending in the first direction, and two intermediate bights, one between each leg and the central bight, the intermediate bights each extending in a second direction, opposite the first direction, and is arranged underneath the seat panel symmetrically to a longitudinal central axis of the seat panel.

20. A chair according to claim 13, wherein a clamping device, preferably a gripping sleeve, is firmly attached to said chair ground support for each of said first legs of said spring.

21. A chair according to claim 13, wherein said backrest carrier terminates at said third pivot and said spring rests behind said third pivot on said backrest carrier, on which the spring exerts an upward force.

22. A chair according to claim 21, wherein said spring arrangement is formed by two tangentially loaded helical springs, each with a coiled spring body and two legs, wherein said springs are arranged next to each other under said seat panel in a mirror image, said spring body surrounding said third pivot, said first leg of said spring, pointing forward, rests against said seat panel and, on said first leg front end, forms said spring section which is attached to said seat panel for said first pivot, and said second leg of said spring, pointing backward, rests on said backrest carrier.

23. A chair according to claim 21, wherein said spring arrangement comprises a one-piece double tangentially loaded helical spring, which is arranged under said seat panel symmetrically to a longitudinal central axis of said seat panel.

24. A chair according to claim 21, wherein a stop, preferably a stop plate, is attached to said chair ground support for restricting an upward movement of each of said first legs of said spring.

25. A chair according to claim 13, wherein at least two front brackets and at least two seat brackets are attached to said underside of said seat panel, through which said first pivot and said second pivot run respectively.

26. A chair according to claim 13, wherein a bearing pin having a rod or tube shape is arranged beneath said seat panel to form said third pivot, wherein said bearing pin is firmly attached to said chair ground support and on which said backrest carrier can tilt.

27. A chair according to claim 13, wherein said seat panel and said backrest carrier are arranged to tilt independently of each other.

28. A chair comprising:

a seat panel, a backrest, a chair ground support, a backrest carrier, and at least one spring, said spring having a horizontal, crosswise running portion pivotally engaged to an underside of said seat panel to form a first pivot near a front end of said seat panel, said backrest carrier arranged to run backward under said seat panel, to engage said underside of said seat panel to form a second, parallel pivot near a rear end of said seat panel, and then to run upward behind said seat panel to carry said backrest, said backrest carrier being pivotally attached to said chair ground support at a third pivot that runs parallel between said first and second pivots, said seat panel being supported solely by said spring near said front end of said seat panel and by said backrest carrier near said rear end of said seat panel, and said spring being arranged so that exerts an upward force on said seat panel and a forward force on said backrest through said backrest carrier, wherein said spring engages said chair ground support with a portion of a length of the spring.

* * * * *